US005566478A

United States Patent [19]

Forrester

[11] Patent Number: 5,566,478

[45] Date of Patent: Oct. 22, 1996

[54] SPORTS SHOE HAVING ROTATABLE TRACTION PAD

[76] Inventor: Randolph Forrester, R.R. #2, Box 438B, Hollis Center, Me. 04042

[21] Appl. No.: 451,231

[22] Filed: May 26, 1995

[51] Int. Cl.[6] ..... A43B 5/00

[52] U.S. Cl. ..... 36/134; 36/128; 36/126

[58] Field of Search ..... 36/128, 134, 126, 36/8.3

[56] References Cited

U.S. PATENT DOCUMENTS

| | | | |
|---|---|---|---|
| 2,109,712 | 3/1938 | Schmalz | 36/8.3 |
| 3,091,043 | 5/1963 | McCorkle | 36/8.3 X |
| 3,204,348 | 9/1965 | Latson | 36/8.3 |
| 3,271,385 | 9/1966 | McAuliffe | 36/134 X |
| 3,354,561 | 11/1967 | Cameron | 36/128 X |

FOREIGN PATENT DOCUMENTS

| | | | |
|---|---|---|---|
| 1565725 | 3/1969 | France | 36/8.3 |
| 2565469 | 12/1985 | France | 36/128 |
| 0239319 | 9/1925 | United Kingdom | 36/126 |

*Primary Examiner*—Ted Kavanaugh
*Attorney, Agent, or Firm*—Frederick R. Cantor, Esq.

[57] ABSTRACT

A shoe is equipped with a circular rotatable traction pad having cleats projecting downwardly a slight distance below the sole bottom surface. The pad is rotatably attached to the shoe sole so that when the wearer of the shoe turns his or her ankle to execute a pivot turn, the shoe turns with the person's ankle while the traction pad remains anchored to the ground surface. The rotatable traction pad facilitates pivot turning maneuvers, and minimizes ankle injuries associated with such maneuvers.

5 Claims, 2 Drawing Sheets

SPORTS SHOE HAVING ROTATABLE TRACTION PAD

BACKGROUND OF THE PRESENT INVENTION

1. Field of the Invention

This invention relates to a sports shoe having particular utility for use in sporting activities, such as basketball, tennis and baseball, requiring quick changes of direction.

2. Prior Developments

In some sports activities, the person is required to turn his or her foot so that the ball area of the foot swivels relative to the ground surface. In effect, the foot is required to rotate around an imaginary vertical axis passing through the ball area of the foot. One example of such a turning maneuver would be a basketball player's quick change of direction as the player maneuvers or turns around, to change the ball path or to intercept the person controlling the ball. Another example would be a tennis player changing direction to reach a fast-moving tennis ball.

Conventional sports shoes are not adapted to help the player make abrupt, pivot-like, turning maneuvers.

The sole bottom surface of the conventional shoe is required to skid in a rotational orbit in order to produce a pivot turn of the player's foot. High gravitational forces between the shoe and the ground (floor) surface oppose such skidding motion, so that usually the person is unable to make pivot turns, changing directions, in the desired fashion. In some cases, the person's upper body will make a turning motion while the foot (shoe) is planted on the ground surface, thereby twisting and stressing ligaments in the ankle.

SUMMARY OF THE PRESENT INVENTION

The present invention is directed to a sports shoe having a rotatable traction pad in the shoe sole, whereby the wearer of the shoe is enabled to turn his or her ankle to execute a pivot turn, with the assurance that the foot will turn with the ankle. The aim is to prevent stress on the ankle that would result from the foot being planted (anchored) to the ground surface while the ankle is being turned.

The rotatable traction pad is preferably located relatively close to the toe area of the shoe, and relatively far away from the heel area of the shoe, so as to be located directly below the ball area of the person's foot, which is the area of maximum pressure and pivot action. When a person attempts a pivot turn, there is a natural tendency to lift the heel area slightly, such that the area of maximum pressure is the ball area of the foot. By locating the rotatable traction pad directly underneath the ball area of the foot, the pad is enabled to greatly assist the turning change (of direction) maneuver.

The term "rotatable traction pad" is used in a relative sense, to indicate that the traction pad is capable of rotation relative to the sole area of the shoe. In an absolute sense, the pad is stationary, while the shoe is rotating. Thus, as the person turns his or her ankle, the foot and shoe rotate with the ankle, while the traction pad remains anchored to the floor or ground surface. In a relative sense, the pad is rotatable.

The traction pad preferably is rotatably mounted in a circular cavity in the shoe sole, such that the traction cleats on the pad lower surface project a slight distance below the shoe sole bottom surface. The sole bottom surface is thus spaced a slight distance from the ground surface so that it can move without excessive frictional drag, as would prevent or impede the shoe turning action.

Preferably the mounting means for the traction pad comprises a commercially available anti-friction bearing assembly located in the aforementioned cavity directly above the traction pad. The traction pad can be removably attached to the anti-friction bearing assembly, so that when the traction pad cleats become worn, the pad can be replaced, without disturbing the bearing assembly.

The nature and preferred construction of the rotatable traction pad will become more apparent from the attached drawings and description of a representative embodiment of the invention.

In summary, and in accordance with the above discussion, the foregoing objectives are achieved in the following embodiments.

1. In a shoe that includes a sole having a bottom surface, the improvement comprising;

a cavity in the shoe sole bottom surface;

a circular traction pad located within said cavity;

said traction pad having a central axis; and means for rotatably mounting said traction pad in the cavity, whereby the pad is rotatable around said central axis.

2. The improvement of paragraph 1, wherein said traction pad has a lower surface located below the plane of the sole bottom surface.

3. The improvement of paragraph 1, wherein said traction pad has a lower surface that includes traction cleats projecting downwardly beyond the sole bottom surface.

4. The improvement of paragraph 1, wherein said traction pad is formed of a resilient elastomeric material.

5. The improvement of paragraph 1, wherein said traction pad mounting means comprises an anti-friction bearing means.

6. The improvement of paragraph 5, wherein said anti-friction bearing means comprises an inner race concentric around said central axis, an outer race surrounding said inner race, and anti-friction bearing elements interposed between said inner and outer races.

7. The improvement of paragraph 6, wherein said cavity comprises a roof surface;

said pad mounting means comprising a post projecting downwardly from said roof on said central axis; and said inner race being affixed to said post.

8. The improvement of paragraph 7, wherein said traction pad comprises an annular flange extending parallel to said central axis to encircle said outer race, whereby said pad is secured to said outer race.

9. The improvement of paragraph 8, wherein said pad flange has a frictional grip on said outer race, whereby the traction pad is removable from said anti-friction bearing means.

10. The improvement of paragraph 7, wherein said post comprises an annular sleeve integral with the shoe sole, and a rigid reinforcement pin located within said sleeve to resist radial compression of said sleeve.

11. The improvement of paragraph 7, and further comprising an annular rigid disk seated against said roof surface in surrounding relation to said post;

the inner race of said anti-friction bearing means having an end surface abutting said rigid disk, whereby part of the axial load forces on said pad are applied to said rigid disk.

12. The improvement of paragraph 1, wherein the shoe sole comprises a toe area defining the front end of the shoe, a heel area defining the rear end of the shoe, and two side edges; and said cavity being located relatively close to the front end of the shoe and relatively far away from the rear end of the shoe.

13. The improvement of paragraph 12, wherein said cavity is located so that said central rotational axis is positioned at a point about thirty (30) percent of the distance from the shoe front end to the shoe rear end, whereby said traction pad is adapted to underlie the ball area of the shoe wearer's foot.

DESCRIPTION OF THE PREFERRED EMBODIMENTS OF THE PRESENT INVENTION

Figure 1:
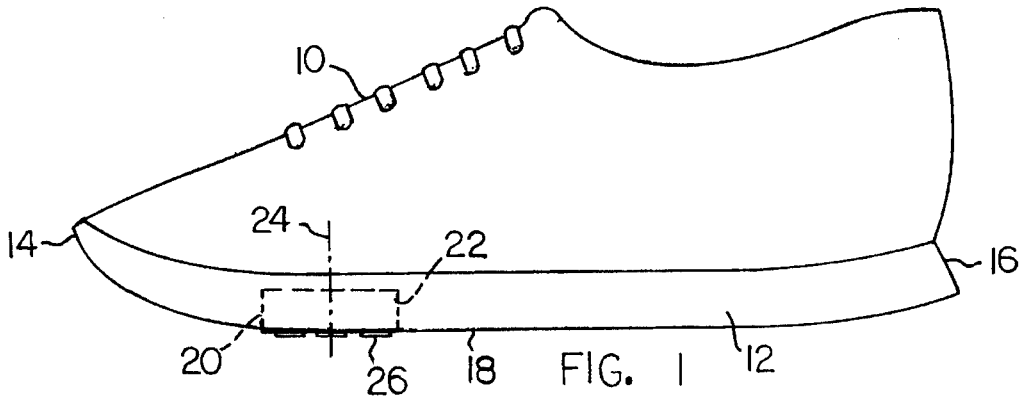
FIG. 1, is a side elevational view, of a sports shoe having a rotatable traction pad of the present invention incorporated therein.

FIG. 1, is a side elevational view, of a sports shoe having a rotatable traction pad of the present invention incorporated therein.

Figure 2:
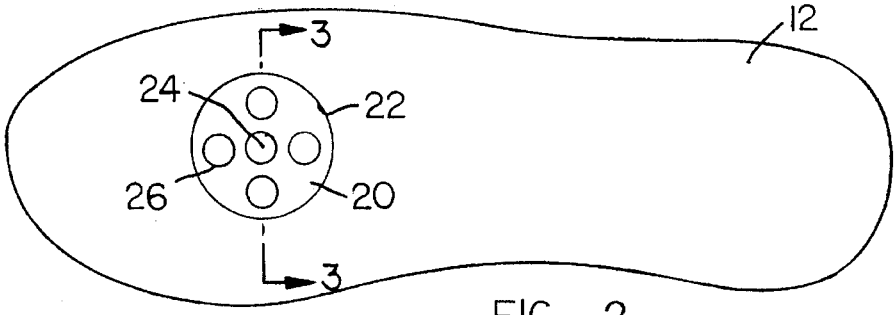
FIG. 2, is a bottom plan view, off the shoe depicted in FIG. 1.

FIG. 2, is a bottom plan view, of the shoe depicted in FIG. 1.

Referring now to FIGS. 1 and 2, there is shown a generally conventional sports shoe 10, having a relatively thick sole 12 formed of rubber, or similar resilient elastomeric material. As shown, the toe area 14 of the sole is upturned. Similarly, the heel area 16 of the sole 12 is upturned, but only slightly. The major surface of the sole is essentially flat. Grooves, not shown, can be formed in bottom surface 18 of the shoe sole 12 for improving the traction of the sole on the ground or pavement surface. Typically, the sole 12 will have a vertical thickness of about one inch (except at the toe area of the sole).

The invention is concerned particularly with a rotatable traction pad 20 located within a cavity 22 on the lower surface of shoe sole 10. As shown in FIG. 2, the pad 20 has a circular shape in the plan view, whereby the pad 20 is rotatable within cavity 22 around a central axis 24 defined by the pad circular edge. The pad has five circular (cylindrical) cleats 26, that project downwardly below sole bottom surface 18 a relatively slight distance, so as to have good tractive engagement with the ground surface.

Traction Pad 20, and cavity 22 are located so that pivot axis 24 is about thirty (30) percent of the distance from toe 14 to heel 16, such that pad 20 is located directly below the ball area of the person's foot. When the wearer of the shoe attempts a pivot turn, he or she, will inherently lift the heel slightly, so that the person's weight is concentrated on the ball area of the foot. Pad 20 is located below the ball area of the foot, whereby the person's weight tends to keep the pad anchored to the ground surface, while the shoe turns around the pivot axis to execute the pivot turn.

Figure 3:
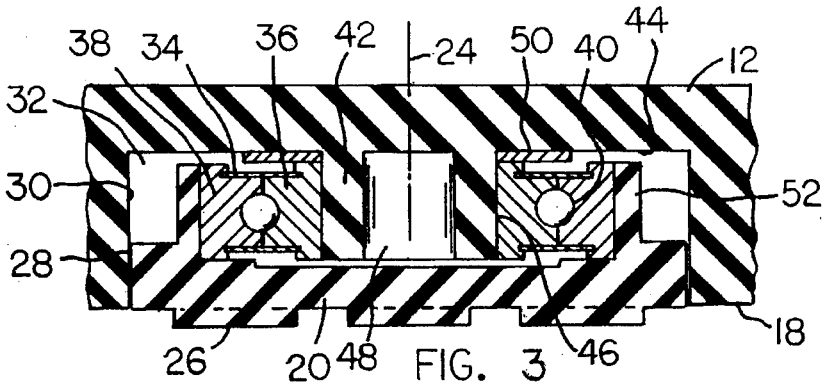
FIG. 3, is a fragmentary sectional view, taken on line 3—3 in FIG. 2.

FIG. 3, is a fragmentary sectional view, taken on line 3—3 in FIG. 2.

FIG. 3, shows structural details of an illustrative traction pad and rotatable pad mounting means that can be used in practice of the invention. As shown, the circular pad 20 is formed of a resilient elastomeric material so as to have a circular edge 28 in close proximity to the circular (cylindrical) side surface 30 of cavity 22. The pad 20 is rotatable around central axis 24, while the clearance between surfaces 28 and 30 is kept as small as possible to preclude entrance of dirt into the annular clearance.

An annular vacant space 32 is provided in cavity 22 above pad 20 to accommodate dirt particles that might migrate into (and through) the annular clearance between surfaces 28 and 30. The traction pad 20 is rotatably mounted in cavity 22 by means of a conventional anti-friction bearing 34. As shown in FIG. 3, the anti-friction bearing 34 comprises an inner race 36, an outer race 38, and a single row of ball bearings 40, interposed between the inner and outer races.

A post 42 projects downwardly from roof surface 44 of cavity 22 within the central space defined by inner race 36. The outer cylindrical surface 46 of the post is affixed to race 36, by frictional forces or by adhesive means.

Post 42 has a resilient cylindrical surface 46 in contact with race 36, in order to promote a fixed grip-type mounting of the race,in cavity 22. However, the core area of the post 42 is preferably rigidified by a steel pin or tube 48; the pin or rigid tube 48 prevents the surrounding elastomeric sleeve portion of the post 42 from shifting or deforming cylindrically, as could lead to fatigue failure.

In order to further reinforce the pad mounting structure, there is provided a rigid annular disk (or washer) 50 formed of rigid plastic or steel. The annular disk 50 is seated against roof surface 44 so that the upper end of race 36 abuts against the disk. The disk 50 distributes some of the axial load imposed on the bearing assembly onto roof surface 44, such that unit area loads on surface 44 are relatively small. Some of the axial load is carried by the post 42 (due to its connection with race 36).

Traction pad 20 is affixed to the outer race 38 of the anti-friction bearing 34 by means of an annular flange 52 integral with the pad. Flange 52 extends axially from the pad upper surface so as to frictionally grip the outer surface of race 38. When (or if) the cleats 22 on pad 20 become worn or degraded the pad 20 can be removed from the anti-friction bearing by pulling the pad downwardly so that flange 52 is peeled away from the surface of race 38. The pad can also be removed from the bearing should it be necessary to remove dirt or debris from the clearance space between the surfaces 28 and 30.

Figure 4:
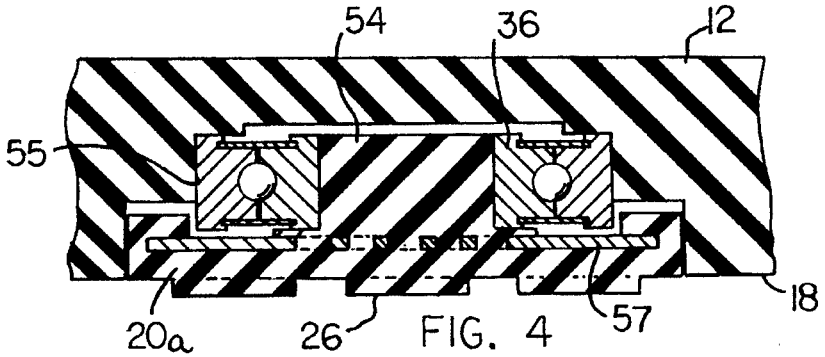
FIG. 4, is a sectional view, taken in the same direction as FIG. 3, but showing another embodiment of the invention.

FIG. 4, is a sectional view, taken in the same direction as FIG. 3, but showing another embodiment of the invention.

FIG. 3 represents a preferred traction pad construction and pad mounting mechanism. However, other arrangements can be used in practice of the invention. FIG. 4 shows one alternate arrangement that can be used.

As shown in FIG. 4, the resilient elastomeric traction pad **20*a* has an upwardly projecting post 54 frictionally engaged with the inner race 36 of the anti-friction bearing, whereby the traction pad is rotatable with the inner race. The outer race 38 of the bearing is affixed to cavity side surface 55 by frictional forces and/or adhesives. Pad 20*a* has a molded rigid reinforcement disk 57 therein, to rigidify (stiffen) peripheral edge areas of the pad 20*a***.

Operationally, the FIG. 4 traction pad is similar to the FIG. 3 pad, the essential difference being that in the FIG. 4 arrangement, the pad is affixed to the inner race of the anti-friction bearing, rather than to the outer race. The FIG. 4 pad may be removed from the inner race of the bearing by pulling and rotating the pad so as to break the connection between elastomeric post 54 and inner race 36.

Figure 5:
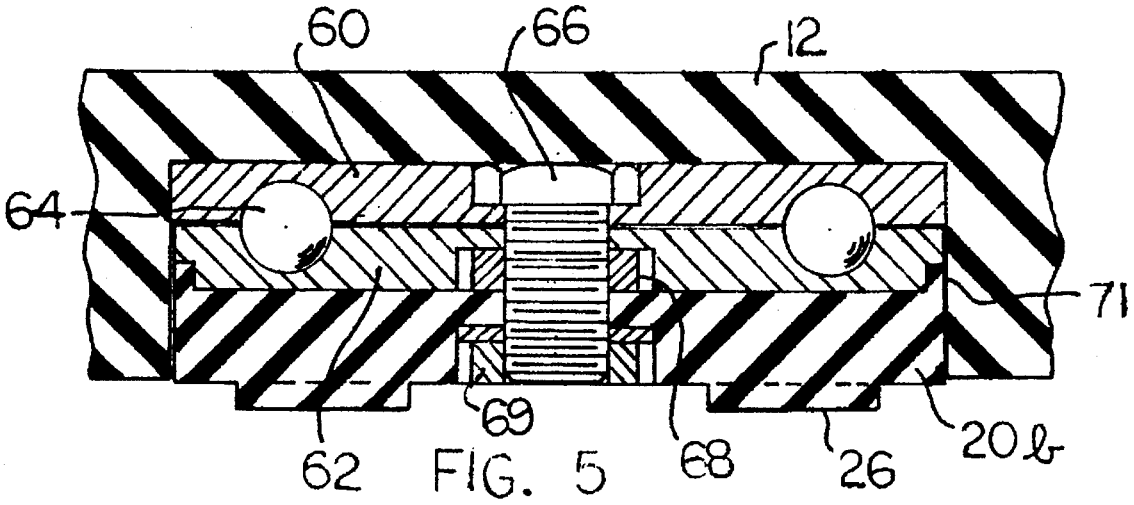
FIG. 5, is a sectional view, taken in the same direction as FIG. 3, but illustrating a third embodiment of the invention.

FIG. 5, is a sectional view, taken in the same direction as FIG. 3, but illustrating a third embodiment of the invention.

FIG. 5, shows a third arrangement, wherein the anti-friction bearing comprises an upper radially-extending race 60, a lower radially-extending race 62, and an array of anti-friction balls 64 located between the two races. A central bolt 66 extends vertically downwardly through the two races into the body of the traction pad **20*b*. A first nut 68 is threaded onto bolt 66 to hold the two races 60 and 62** in operational relationship.

A second nut 69 is threaded onto bolt 66 to partially retain pad **20*b* on lower race 62. Pad 20*b* is equipped with an annular flange 71 that frictionally grips an axial edge surface on race 62, whereby the peripheral portion of pad 20*b* is attached to race 62. The pad 20*b* can be removed from the anti-friction bearing by unscrewing nut 69 and pulling the pad off of race 62**.

The traction pad of FIG. 5 operates in essentially the same fashion as the traction pads of FIGS. 3 and 4. As indicated earlier, FIG. 3 represents the preferred traction pad arrangement.

The invention contemplates a shoe construction having a cavity in the shoe sole directly below the area where the ball area of the person's foot is located. A rotatable traction pad is mounted within the cavity so that the traction cleats on the lower surface of the pad project downwardly slightly below the sole bottom surface.

When a person exerts a turning force on the shoe the person's weight is applied through the traction pad to the ground surface, so that the shoe can turn with the person's ankle, thereby facilitating the turning maneuver and possibly preventing an ankle injury.

Preferably, the traction pad is mounted in the cavity by an anti-friction bearing assembly, i.e., a bearing assembly that includes two separated races and a series of anti-friction balls, or rollers, interposed between the races to minimize the frictional drag forces. The traction pad is preferably mounted so that it can be removed and replaced, e.g., when the traction cleats become worn, or when dirt becomes embedded in the clearance space between the pad and cavity.

The present invention describes a sports shoe having rotatable traction pad. The drawings herein necessarily depict specific structural features and embodiments of the sports shoe having rotatable traction pad.

However, it will be appreciated by those skilled in the arts pertaining thereto, that the present invention can be practiced in various alternate forms and configurations. Further, the previously detailed descriptions of the preferred embodiment of the present invention, are presented for purposes of clarity of understanding only, and no unnecessary limitations should be implied therefrom. Finally, all appropriate mechanical and functional equivalents to the above, which may be obvious to those skilled in the arts pertaining thereto, are considered to be encompassed within the claims of the present invention.

What is claimed is:

1. In a shoe that includes a sole having a bottom surface, the improvement comprising:

a circular cavity in the shoe sole bottom surface;

a circular traction pad located within said cavity; said traction pad having a central axis; and means for rotatably mounting said traction pad in said cavity, whereby the pad is rotatable around said central axis;

said mounting means comprising a unitary radial anti-friction bearing assembly formed separately from said shoe sole and traction pad; said bearing assembly being centered on said central axis, and comprising an inner race connected to the shoe sole, an outer race connected to said traction pad, and anti-friction bearing elements interposed between said inner and outer races;

said traction pad being formed of a resilient elastomeric material, said elastomeric pad having an integral annular flange extending parallel to said central axis, said flange having a telescopic frictional grip on said outer race, whereby the traction pad is removable from said outer race without disturbing said anti-friction bearing assembly.

2. The improvement of claim 1, wherein said cavity comprises a roof surface, and a post projecting downwardly from said roof surface on said central axis; said inner race having a telescopic grip fit on said post, whereby said inner race has a fixed connection with the shoe sole.

3. The improvement of claim 2, wherein said post comprises an annular sleeve integral with the shoe sole, and a rigid reinforcement pin located within said sleeve to resist radial compression of said sleeve.

4. The improvement of claim 2, and further comprising an annular rigid disk seated against said roof surface in surrounding relation to said post; the inner race of said anti-friction bearing assembly having an end surface abutting said rigid disk, whereby part of the axial load forces on said traction pad are applied to said rigid disk.

5. The improvement of claim 1, wherein said circular cavity has a cylindrical side surface; and the annular flange on said elastomeric pad being spaced radially inwardly from said cylindrical side surface a significant distance, to form an annular dirt-collection pocket surrounding said annular flange.

* * * * *